United States Patent [19]

Johnson

[11] 4,263,924

[45] Apr. 28, 1981

[54] COIN SEPARATING DEVICE

[75] Inventor: Raymond A. Johnson, Hot Springs, Ark.

[73] Assignee: U.M.C. Industries, Inc., Stamford, Conn.

[21] Appl. No.: 956,968

[22] Filed: Nov. 2, 1978

[51] Int. Cl.[3] ..... G07D 3/12

[52] U.S. Cl. ..... 133/3 C; 194/102

[58] Field of Search ..... 133/3 R, 3 C; 194/99, 194/102

[56] References Cited

U.S. PATENT DOCUMENTS

| | | | |
|---|---|---|---|
| 502,715 | 8/1893 | Gunther | 133/3 D |
| 794,620 | 7/1905 | Hall | 133/3 D |
| 1,039,604 | 9/1912 | Smith | 133/3 R |
| 1,280,539 | 10/1918 | Pollock | 194/102 |
| 2,000,462 | 5/1935 | Brodd | 194/102 |
| 2,292,628 | 8/1942 | Fry | 194/99 |
| 2,420,246 | 5/1947 | Keller | 133/3 R X |
| 2,463,161 | 3/1949 | DuGrenier et al. | 133/3 R X |
| 2,744,603 | 5/1956 | Haverstick | 194/102 |

OTHER PUBLICATIONS

*Rejector Manual 1-15,1-19 Series,* National Rejectors Industries, Hot Springs, Ark.

*Primary Examiner*—F. J. Bartuska

*Attorney, Agent, or Firm*—Rogers, Eilers & Howell

[57] ABSTRACT

A coin separating device has a movable coin director which is mounted intermediate an inlet for coins of different predetermined diameters and a plurality of outlets that are generally in register with each other but that are located in separate planes. That coin director responds to the reception thereby of a coin of one of those predetermined diameters to be in a position to direct that coin to one of those outlets; and that coin director responds to the reception thereby of a further coin of another of those predetermined diameters to be in a different position to direct that further coin to another of those outlets.

28 Claims, 16 Drawing Figures

FIG. 1.
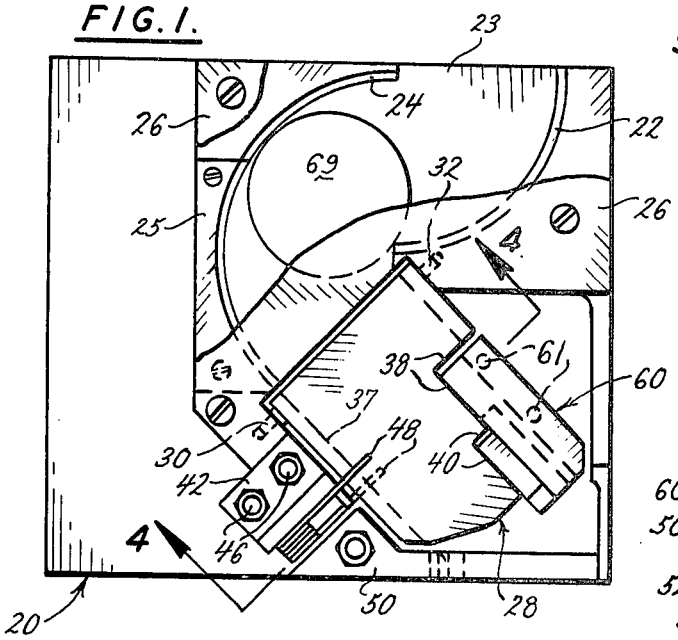
FIG. 2.
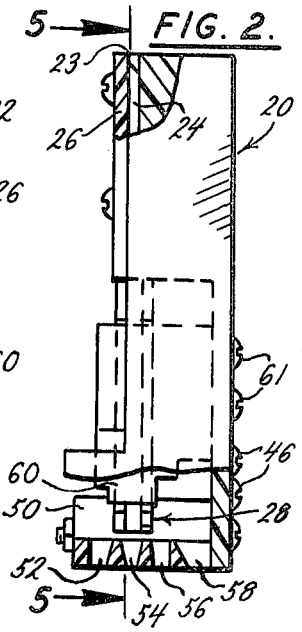
FIG. 3.
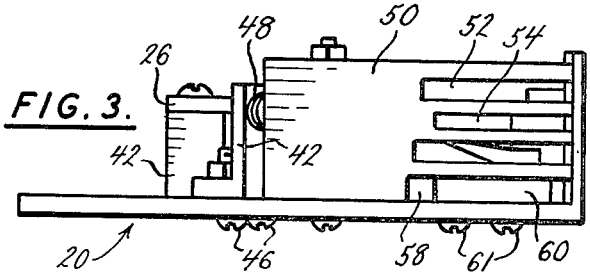
FIG. 9.
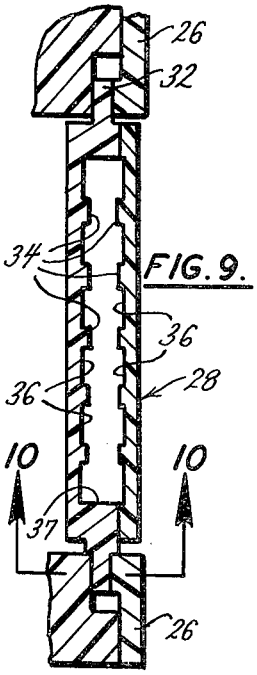
FIG. 4.
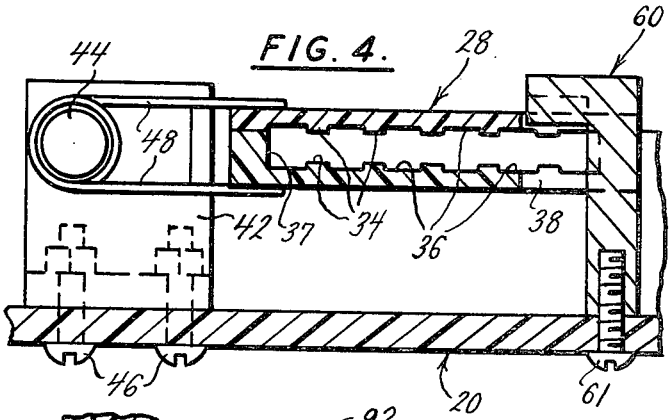
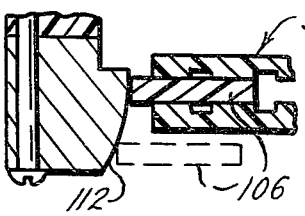
FIG. 16.
FIG. 10.
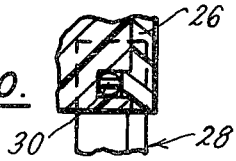

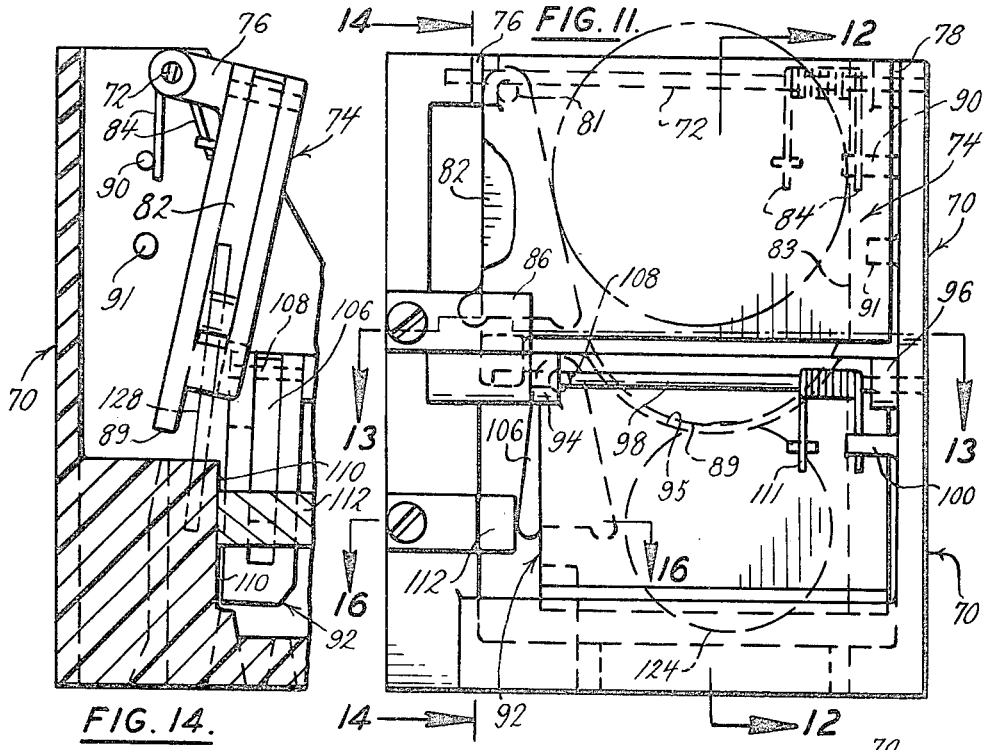
FIG. 11.
FIG. 14.
14
12
13
16
76
72
84
90
82
91
74
78
70
108
106
128
89
110
112
92
81
86
83
94
98
95
111
100
124
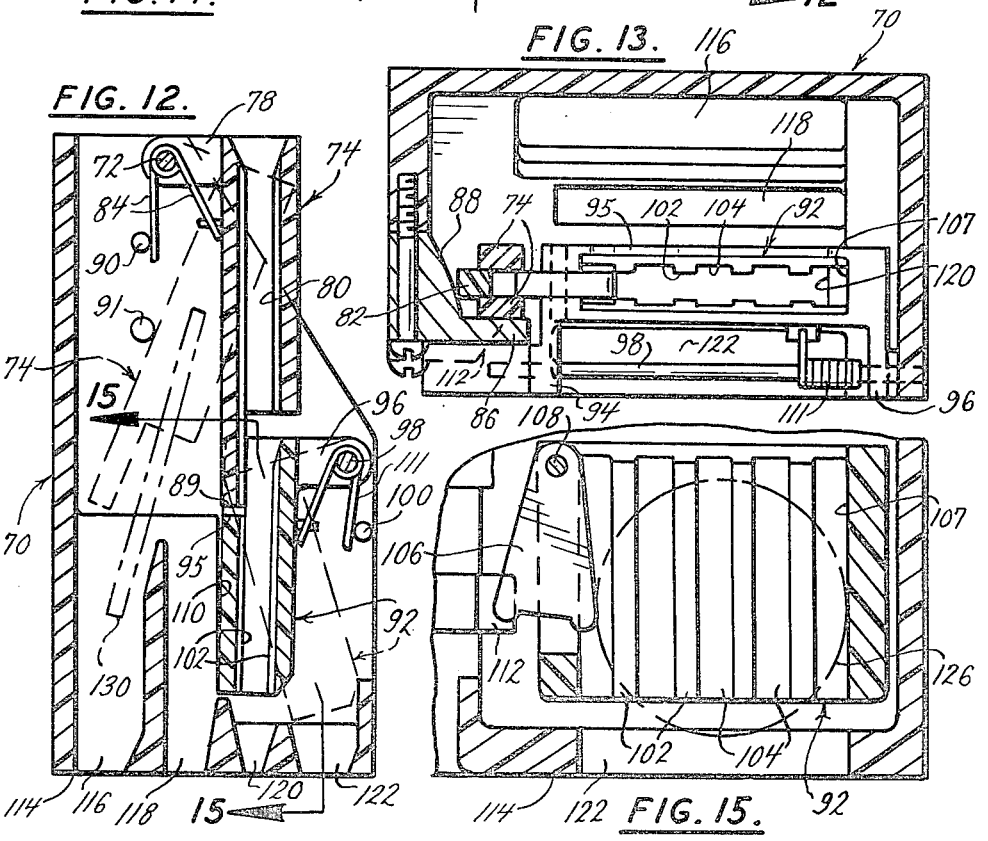
FIG. 12.
FIG. 13.
FIG. 15.
15
78
72
84
90
91
74
80
82
96
98
111
100
89
95
110
102
92
130
114
116
118
120
122
70
88
94
86
108
107
106
112
126
104

COIN SEPARATING DEVICE

BACKGROUND OF THE INVENTION

Slug rejectors have been known and used for many years; and many of those slug rejectors tested inserted coins and slugs and then directed acceptable coins of different denominations to different outlets. As a result, those slug rejectors performed coin-testing plus coin-separating functions.

SUMMARY OF THE PRESENT INVENTION

The coin separating device of the present invention can be used with a slug rejector that will test coins and slugs but that will not direct acceptable coins of different denominations to different outlets and, instead, will direct all acceptable coins to the same outlet. That coin separating device has a movable coin director which is mounted intermediate an inlet for coins of different predetermined diameters and a plurality of outlets that are generally in register with each other but that are located in separate planes. That coin director responds to the reception thereby of a coin of one of those predetermined diameters to be in a position to direct that coin to one of those outlets; and that coin director responds to the reception thereby of a further coin of another of those predetermined diameters to be in a different position to direct that further coin to another of those outlets. It is, therefore, an object of the present invention to provide a coin separating device with a movable coin director that receives coins of different predetermined diameters and directs coins of one of those predetermined diameters to a first outlet which lies in a first plane and directs coins of another of those predetermined diameters to a second outlet which lies in a second plane.

The coin separating device has diameter sensing means; and the coin director coacts with said diameter sensing means to respond to a coin of the one predetermined diameter to direct that coin to the one outlet in the one plane and to respond to a coin of another of those predetermined diameters to direct that coin to another of those outlets in another plane. The coin director and diameter sensing means coact, quickly and automatically, to direct the coins of different diameters to the outlets therefor. It is, therefore, an object of the present invention to provide a coin separating device with a movable coin director that coacts, quickly and automatically, with diameter sensing means to direct coins of one diameter to an outlet in one plane and to direct coins of another diameter to another outlet in another plane.

Other and further objects and advantages of the present invention should become apparent from an examination of the drawing and accompanying description.

In the drawing and accompanying description two preferred embodiments of the present invention are shown and described but it is to be understood that the drawing and accompanying description are for the purpose of illustration only and do not limit the invention and that the invention will be defined by the appended claims.

BRIEF DESCRIPTION OF THE DRAWING

In the drawing,

FIG. 1 is a partially broken-away, front elevational view of one preferred embodiment of coin separating device that is made in accordance with the principles and teachings of the present invention, FIG. 2 is a partially broken-away, partially sectioned elevational view of the right-hand end of the coin separating device of FIG. 1.

FIG. 3 is a bottom view of the coin separating device of FIG. 1,

FIG. 4 is a sectional view, on a larger scale, through the coin separating device of FIG. 1, and it is taken along the plane indicated by the line 4—4 in FIG. 1, FIG. 9 is a further sectional view, on the scale of FIG. 4, and it is taken along the plane indicated by the line 9—9 in FIG. 6, FIG. 10 is yet another sectional view, on the scale of FIG. 4, and it is taken along the plane indicated by the line 10—10 in FIG. 9, FIG. 11 is a front elevational view of a second preferred embodiment of coin separating device that is made in accordance with the principles and teachings of the present invention, FIG. 12 is a sectional view through the coin separating device of FIG. 11, and it is taken along the plane indicated by the line 12—12 in FIG. 11, FIG. 13 is a sectional view that is taken along the broken plane indicated by the broken line 13—13 in FIG. 11, FIG. 14 is a sectional view that is taken along the plane indicated by the line 14—14 in FIG. 11, FIG. 15 is a sectional view that is taken along the broken plane indicated by the broken line 15—15 in FIG. 12, and FIG. 16 is a sectional view that is taken along the plane indicated by the line 16—16 in FIG. 11.

DETAILED DESCRIPTION OF PREFERRED EMBODIMENTS

Figure 5:
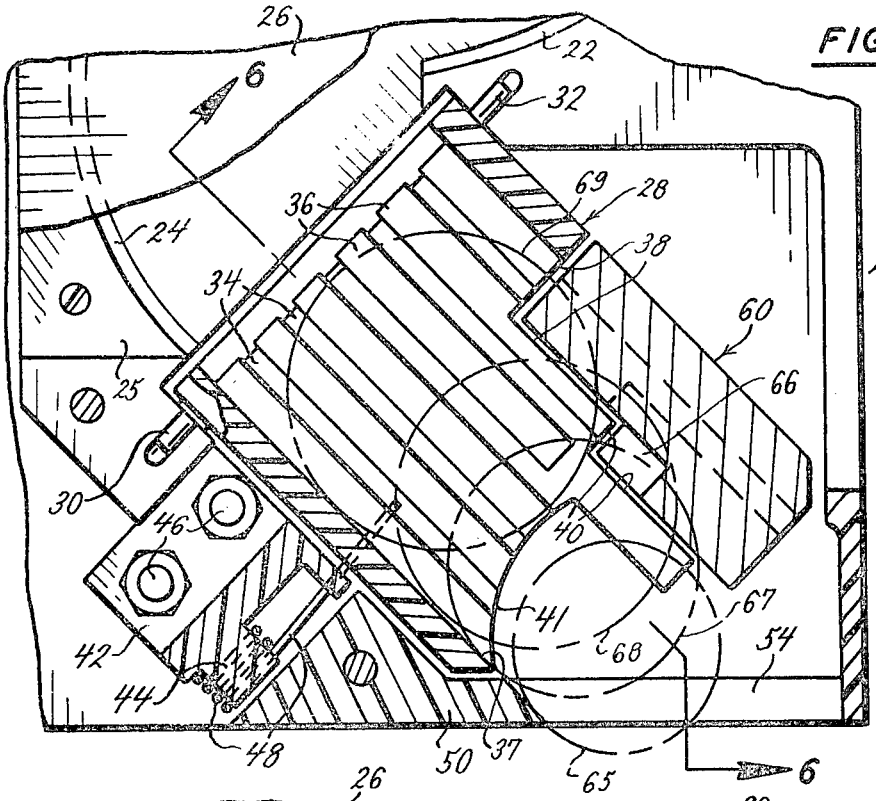
FIG. 5 is a sectional view, on the scale of FIG. 4, through the coin-handling device of FIG. 1, and it is taken along the plane indicated by the line 5—5 in FIG. 2.

Components of Coin Separating Device of FIGS. 1-10

Referring particularly to FIGS. 1-10, the numeral 20 generally denotes one preferred embodiment of coin separating device that is made in accordance with the principles and teachings of the present invention. An arcuate coin runway 22, which has a chamfered surface, extends downwardly from upper right to lower left from an inlet 23 that is dimensioned to accommodate U.S. nickels, dimes, quarters and the new dollar coin. The numeral 24 denotes an arcuate coin guide which has a chamfered surface and which inclines downwardly from upper right to lower left from inlet 23. That coin guide is spaced far enough from the coin runway 22 to permit a new U.S. dollar coin to roll freely along that coin runway. The numeral 25 denotes a portion of the coin guide 24 which is made of hard metal. If desired, of course, all of that coin guide and all of the coin runway 22 could be made of hard metal.

Numeral 26 denotes a closure which has the form of a flat plate; and that closure will help coins, passing downwardly through the inlet 23, to move along the coin runway 22.

The numeral 28 generally denotes a coin director which has stub pivots 30 and 32 extending outwardly from opposite ends of the upper portion thereof. Those stub pivots are held by, but rotate freely relative to, sockets in the coin separating device 20 that are overlain by the closure 26. The coin director 28 has a hollow central portion to permit coins to pass through it; and it has lands 34 and grooves 36 at the surface of that central portion. Those lands will minimize the area of frictional engagement between that surface and coins which pass through that coin director. The numeral 37 denotes the left hand side wall of the coin director 28; and that wall serves as a coin runway as well as a side wall. The numeral 38 denotes an L-shaped notch which is provided in the right-hand edges of the front and rear walls of the coin director 28. The numeral 40 denotes a further L-shaped notch which is provided in the right-hand edges of the front and rear walls of that coin director. The numeral 41 denotes a partially-arcuate, partially-straight notch which is provided in the lower portion of the rear wall of the coin director 28; and that notch is shown particularly by FIG. 5.

The numeral 42 denotes an L-shaped bracket which is secured to the rear wall of the coin separating device 20 by bolt and nut combinations 46. As shown particularly by FIGS. 1 and 5, that L-shaped bracket is disposed to the left of the coin director 28. A short cylindrical boss 44 is formed integrally with the leg of that bracket; and a centering spring 48 has the turns thereof telescoped over that boss. That spring has a front leg which overlies the front wall of the coin director 28, and it has a rear leg which underlies the rear wall of that coin director. Those legs normally hold that coin director in the position which is shown particularly by FIGS. 2 and 6, but that spring can yield to permit that coin director to be rotated either in the clockwise direction or in the counter clockwise direction relative to that position.

The numeral 50 denotes a plate at the bottom of the coin separating device 20; and that plate has outlet slots 52, 54, 56 and 58 therein. The outlet slot 52 is the outlet slot for nickels, and it lies in a plane which is close to, and parallel to, the front of the coin separating device; and the outlet slot 54 is the outlet slot for dimes, and it lies in a plane which is spaced rearwardly of, but is parallel to, the plane in which the nickel outlet slot lies. The outlet slot 56 is the outlet slot for quarters, and it lies in a plane which is spaced rearwardly of, but is parallel to, the plane in which the dime outlet slot lies; and the outlet slot 58 is the outlet slot for new U.S. dollars, and it lies in a plane which is spaced rearwardly of, but is parallel to, the plane in which the quarter outlet slot lies. Coin-directing chutes, not shown, will be provided in the coin-handling equipment with which the coin separating device 20 is to be used; and a nickel-receiving passageway will be immediately below and in register with the outlet slot 52, a dime-receiving passageway will be immediately below and in register with the outlet slot 54, a quarter-receiving passageway will be immediately below and in register with the outlet slot 56, and a dollar-receiving passageway will be immediately below and in register with the outlet slot 58. Those coin-receiving passageways can lead to coin-dispensing tubes, to coin boxes, or to any desired combinations of coin-dispensing tubes and coin boxes.

The numeral 60 generally denotes a cam block which is secured to the rear wall of the coin separating device 20 by fasteners 61. That cam block has an elongated camming surface 62 which has a long planar, upper portion displaced from the vertical by twenty-six degrees and which has a short, planar, vertical lower portion. The numeral 63 denotes an elongated camming surface which has a short, planar, upper portion that is co-planar with the long upper portion of camming surface 62 and which has a long planar portion that is displaced from vertical by five degrees. As indicated particularly by FIGS. 7 and 8, the upper portion of the camming surface 62 inclines downwardly from upper right to lower left, and both portions of the camming surface 63 incline downwardly from upper right to lower left. The camming surface 62 will be engaged by a portion of the periphery of each dollar which passes through the coin separating device 20; and the camming surface 63 will be engaged by a portion of each quarter which passes through that coin separating device. The numeral 66 denotes a short camming surface which has a planar, upper portion displaced from vertical by twenty-three degrees and which has a very short planar, vertical, lower portion. As indicated particularly by FIGS. 7 and 8, the upper portion of the camming surface 66 inclines downwardly from upper left to lower right. That camming surface will be engaged by a portion of the periphery of each nickel which passes through the coin separating device 20. The numeral 64 denotes a short surface which inclines upwardly and to the right from a line, that lies in the plane of the lower portion of camming surface 63, to the upper edge of camming surface 66. The surface 64 is not a camming surface and, instead, is formed on the cam block 60 to provide clearance which will make certain that the upper edge of camming surface 66 will not be engaged by the periphery of any quarter passing through the coin separating device 20.

Operation of Coin Separating Device of FIGS. 1–10

When a dime 65 is introduced into the inlet 23, it will engage the coin runway 22 and be guided by that coin runway and by the coin guide 24 toward the upper end of the hollow central portion of the coin director 28. The chamfer on the upper surface of that coin runway will tend to minimize any tendency of the dime to bounce as it engages that coin runway; and the chamfer on the lower surface of that coin guide will tend to minimize any tendency of that dime to bounce as it engages that coin guide. Consequently, as that dime enters that hollow central portion, it will roll smoothly, and at a moderate speed, along the inner surface of the wall 37 of coin director 28. As shown particularly by FIG. 5, the diameter of a dime is appreciably smaller than the shortest straight-line distance between the inner surface of wall 37 and each camming surface on cam block 60, but is longer than the shortest straight-line distance between that inner surface and the straight, right-hand edge of notch 41 in the rear wall of that coin director. Consequently, a dime will roll through the coin director 28 without engaging any camming surface on cam block 60; and hence will permit the centering spring 48 to continue to hold that coin director in the position shown by FIGS. 2 and 6.

The front and rear walls of that coin director will coact to keep the dime generally parallel to them until the upper edge of the periphery of that dime moves downwardly below the arcuate portion of the notch 41 in that rear wall. Thereafter, the elongated edge of that notch will coact with the momentum of that dime and with the dime outlet slot 54 to tend to keep that dime generally parallel to the front and rear walls of that coin director. As a result, each dime 65 will be guided into and through the dime outlet slot 54.

When a nickel 67 is introduced into the inlet 23, it will engage the coin runway 22 and be guided by that coin runway and by the coin guide 24 toward the upper end of the hollow central portion of the coin director 28. The chamfers on the surfaces of coin runway 22 and of coin guide 24 will minimize any tendency of that nickel to bounce; and hence that nickel will roll smoothly and at a moderate speed as it enters the hollow central portion of that coin director. As shown particularly by FIG. 5, the diameter of a nickel is appreciably smaller than the shortest straight-line distance between the inner surface of wall 37 and camming surface 62 on cam block 60, but is longer than the shortest straight-line distance between that inner surface and the camming surface 66. As shown particularly by FIG. 6, the inclined upper portion of camming surface 66 is in register with the lower section of the hollow central portion of coin director 28; and hence, as a nickel 67 rolls along the inner surface of wall 37 of that coin director, a portion of the periphery of that nickel will engage that inclined upper portion. Thereupon, the force of gravity and the kinetic energy of that nickel will develop action and reaction forces between that nickel and the inclined upper portion of camming surface 66 which will force the coin director 28 to rotate in the counter clockwise direction from the position of FIGS. 2 and 6 toward a position wherein the lower end thereof is generally in register with the nickel outlet slot 52. As the periphery of the nickel reaches, and moves downwardly below, the line of division between the upper and lower portions of the camming surface 66, the coin director 28 will remain essentially stationary.

The front and rear walls of that coin director will coact to keep the nickel generally parallel to them until the upper edge of the periphery of that nickel moves downwardly below the arcuate portion of the notch 41 in that rear wall. Thereafter, the elongated edge of that notch will coact with the momentum of that nickel and with the nickel outlet slot 52 to tend to keep that nickel generally parallel to the front and rear walls of that coin director. As a result, nickel 67 will be guided into and through the nickel outlet slot 52.

When a quarter 68 is introduced into the inlet 23, it will engage the coin runway 22 and be guided by that coin runway and by the coin guide 24 toward the upper end of the hollow central portion of the coin director 28. The chamfers on the surfaces of coin runway 22 and of coin guide 24 will minimize any tendency of that quarter to bounce; and hence that quarter will roll smoothly and at a moderate speed as it enters the hollow central portion of that coin director. As shown particularly by FIG. 5, the diameter of a quarter is longer than the shortest straight-line distance between the inner surface of wall 37 and camming surface 63 on cam block 60. As indicated particularly by FIG. 6, the upper portion of that camming surface is in register with the middle section of the hollow central portion of coin director 28; and hence, as a quarter 68 rolls along the inner surface of wall 37 of that coin director, a portion of the periphery of that quarter will engage that upper portion. Thereupon, the force of gravity and the kinetic energy of that quarter will develop action and reaction forces between that quarter and the inclined upper portion of camming surface 63 which will force the coin director 28 to rotate in the clockwise direction from the position of FIGS. 2 and 6 toward a position wherein the lower end thereof is generally in register with the quarter outlet slot 56. As the periphery of the quarter reaches, and moves downwardly below, the line of division between the upper and lower portions of the camming surface 63, the coin director 28 will remain essentially stationary.

The front and rear walls of that coin director will coact to keep the quarter generally parallel to them until the upper edge of the periphery of that quarter moves downwardly below the arcuate portion of the notch 41 in that rear wall. Thereafter, the elongated edge of that notch will coact with the momentum of that quarter and with the quarter outlet 56 to tend to keep that quarter generally parallel to the front and rear walls of that coin director. As a result, each quarter 68 will be guided into and through the quarter outlet slot 56.

When a dollar 69 is introduced into the inlet 23, it will engage the coin runway 22 and be guided by that coin runway and by the coin guide 24 toward the upper end of the hollow central portion of the coin director 28. The chamfers on the surfaces of coin runway 22 and of coin guide 24 will minimize any tendency of that dollar to bounce; and hence that dollar will roll smoothly and at a moderate speed as it enters the hollow central portion of that coin director. As shown particularly by FIG. 5, the diameter of a dollar is longer than the shortest straight-line distance between the inner surface of wall 37 and camming surface 62 on cam block 60. As indicated particularly by FIG. 6, the upper portion of that camming surface is in register with the middle section of the hollow central portion of coin director 28; and hence, as a dollar rolls along the inner surface of wall 37 of that coin director, a portion of the periphery of that dollar will engage that upper portion. Thereupon, the force of gravity and the kinetic energy of that dollar will develop action and reaction forces between that dollar and the inclined upper portion of camming surface 62 which will force the coin director 28 to rotate in the clockwise direction from the position of FIGS. 2 and 6 toward the position shown by FIG. 7 wherein the lower end thereof is generally in register with the dollar outlet slot 58. As the periphery of the dollar reaches, and moves downwardly below, the line of division between the upper and lower portions of the camming surface 62, the coin director 28 will remain essentially stationary.

The front and rear walls of that coin director will coact to keep the dollar generally parallel to them until the upper edge of the periphery of that dollar moves downwardly below the arcuate portion of the notch 41 in that rear wall. Thereafter, that dollar will be able to tilt about the elongated straight edge of that notch.

Figure 6:
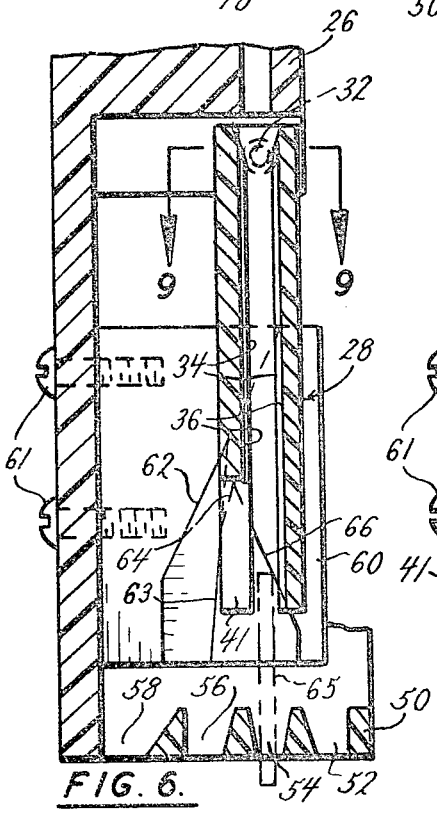
FIG. 6 is a another sectional view, on the scale of FIG. 4, and it is taken along the broken plane indicated by the broken line 6—6 in FIG. 5.
Figure 7:
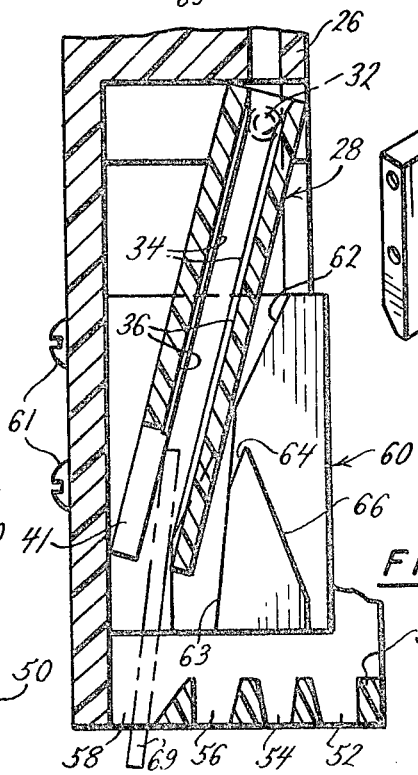
FIG. 7 is a sectional view on the scale of FIG. 4, which is similar to that of FIG. 6, but wherein the coin director has been rotated in the clockwise direction from the position of FIG. 6.
Figure 8:
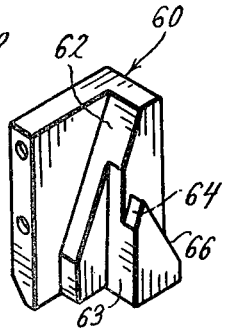
FIG. 8 is a perspective view of a plural-surface cam which is used in the coin separating device of FIG. 1.

The stub pivots 30 and 32 define an axis of oscillation for the coin director 28 which is displaced about forty-five degrees from horizontal; and that displacement causes the plane of the rear wall of that coin director to shift relative to the plane of the rear wall of the coin separating device 20 as that coin detector rotates in the clockwise or counterclockwise direction from the normal position of FIGS. 2 and 6. The extent of rotation of that coin director is so small, when a quarter or a nickel is inserted, that the shifting of the former plane due to that rotation can not permit the rear wall of that coin director to interfere with downward movement of nickels and quarters after those coins have entered the nickel outlet slot 52 and the quarter outlet slot 56, respectively. However, the extent of the rotation of that coin director is so large, when a dollar is inserted, that the shifting of the plane of the rear wall of that coin director relative to the plane of the rear wall of that coin separating device could tend to cause that rear wall to interfere with the downward movement of that dollar through the dollar outlet slot 58. However, the notch 41 permits the left-hand edge of a dollar, as the upper portion of the periphery of that dollar moves downwardly below the arcuate edge of that notch to start rotating about the straight edge of that notch until it is close to the rear wall of that coin separating device. As that left-hand edge does so, the dollar will shift the plane thereof closer to the plane of the dollar outlet 58; and hence that dollar will be free to move downwardly through that dollar outlet.

The lower portions of the camming surfaces 66, 63 and 62 on the cam block 60 are engaged, respectively, by portions of the peripheries of nickels, quarters and dollars, after preceding portions of those peripheries have engaged, and have moved downwardly below, the upper portions of those camming surfaces. The action and reaction forces, which develop between the nickels, quarters and dollars and the camming surfaces 66, 63 and 62, respectively, will not effect any appreciable changes in the position of the coin director 28. Instead, those action and reaction forces will merely resist the restorative forces applied by the centering spring 48, and thereby will make it possible to hold the lower end of that coin director in the positions to which it moved in response to the action and reaction forces that developed as a nickel, quarter and dollar engaged camming surface 66, 63 or 62, respectively. After the peripheries of the coins have moved downwardly below, and out of engagement with, the camming surfaces corresponding thereto, the centering spring 48 will promptly and automatically return the coin directors 28 to the normal position of FIGS. 2 and 6.

It will be noted that the coin separating device 20 automatically and quickly directs coins of four different diameters to four outlets which are generally in register with each other but which are located in four different, parallel planes. By keeping those four outlets generally in register with each other, the present invention makes it possible for the outlets 52, 54 and 56 to have the spacings and positionings of the nickel, dime and quarter outlets of commercially-available three-coin slug rejectors. Also, by keeping the outlets 52, 54, 56 and 58 generally in register with each other, the present invention makes it possible for the width of that coin separating device to be very much smaller than the width of a coin separating device that directed coins of four different diameters to four outlets which were in the same plane. The depth of the coin separating device 20 is, of course, greater than the depth of a coin separating device which has all of the outlets thereof in the same plane; but the depth of the coin separating device 20 is not appreciably greater than the depth of a commercially-available four-coin slug rejector.

Components Of Coin Separating Device Of FIGS. 11–16

Referring particularly to FIGS. 11–16, the numeral 70 generally denotes a second preferred embodiment of coin separating device which is made in accordance with the principles and teachings of the present invention. The numeral 72 denotes an elongated, horizontally-directed pivot adjacent the top of that device; and the numeral 74 generally denotes a coin director which has arms 76 and 78 that encircle, and that are supported by and rotate relative to, that pivot. As shown particularly by FIGS. 12 and 14, those arms extend rearwardly from that coin director. Lands 80 are provided at the inner surface of the hollow central portion of that coin director; and those lands will minimize the area of frictional engagement between that inner surface and coins passing through that hollow central portion. The numeral 81 denotes a short pivot which extends forwardly from the upper left-hand portion of the rear wall of the coin director 74, as shown particularly by FIG. 11. A cam follower 82, which has the form of a triangular pendant, is rotatably mounted on the pivot 81 and is disposed between the front and rear walls of that coin director. That cam follower constitutes a movable left-hand wall for that coin director; and the numeral 83 denotes the fixed right-hand wall of that coin director. The rear wall of that coin director has a convex lower edge 89 which extends downwardly below the level of the bottom of the cam follower 82.

The numeral 90 denotes a pin which is secured to the right hand wall of the coin separating device 70; and the numeral 84 denotes a torsion spring which is wound around the elongated pivot 72. One end of that spring bears against pin 90, and the other end of that spring bears against the rear wall of coin director 74. That spring urges that coin director for movement in the counterclockwise direction in FIGS. 12 and 14, but a stop 86 limits the extent of that movement. The spring 84 and the stop 86 normally hold the coin director 74 in the position shown by FIG. 12; but that spring can yield to permit that coin director to move to the position shown by FIG. 14, and can yield even further to permit that coin director to move to the position shown by dotted lines in FIG. 12. A stop 91 keeps that coin director from moving any further in the clockwise direction. A cam 88, which is shown particularly by FIG. 13, is mounted rearwardly of the stop 86. As indicated by FIG. 11, that cam is in register with the lower portion of the left-hand edge of cam follower 82. The center of gravity of that cam follower will tend to cause that cam follower to assume a position to the left of that shown in FIG. 11; but the cam 88 will keep that cam follower from assuming that position when the cam director 74 is in engagement with stop 86.

The numeral 92 generally denotes a second coin director for the coin separating device 70. Arms 94 and 96 extend forwardly from the upper portion of that coin director to encircle and be supported by an elongated horizontal pivot 98. That pivot is located close to the vertical mid-point of that separating device. The upper edge of the rear wall of the coin director 92 has a concave notch 95 therein; and that notch normally receives the convex lower end 89 of the rear wall of coin director 74, as shown by FIG. 12. A pin 100 extends inwardly from the right-hand wall of that coin separating device at a point which is disposed forwardly of the pivot 98. Lands 102 and grooves 104 are provided at the inner surface of the hollow central portion of coin director 98 and those lands minimize the areas of frictional engagement between that inner surface and coins which pass through that hollow central portion. The numeral 108 denotes a pivot which extends forwardly from the upper left-portion of the rear wall of that coin director, as shown by FIG. 15. A cam follower 106, which has a form of a triangular pendant and which serves as a movable left-hand wall for coin director 92, is rotatably supported by that pivot. The number 107 denotes the fixed right-hand wall of that coin director. A stop 110 is provided adjacent the rear of the coin director 92, as shown by FIGS. 13 and 14; and that stop limits the extent to which that coin director can rotate rearwardly about pivot 98.

A torsion spring 111 encircles the pivot 98; and it has one end thereof bearing against the pin 100 while the other end thereof bears against the front wall of coin director 92. That spring normally holds that coin director in the position shown by FIGS. 12-14, but it can yield to permit that coin director to move to the dotted-line position of FIG. 12. The numeral 112 denotes a cam which is mounted in register with the cam follower 106, as shown by FIGS. 11, 13, 15 and 16. The center of gravity of that cam follower will tend to cause that cam follower to assume a position to the left of that shown in FIG. 11; but the cam 112 will keep that cam follower from assuming that position when the coin director 92 is in engagement with stop 110.

The numeral 114 denotes the bottom of the coin separating device 70; and that bottom has a dollar outlet 116, a quarter outlet 118, a dime outlet 120, and a nickel outlet 122. Those outlets are generally in register with each other, but they are located in spaced-apart parallel planes.

Operation Of Coin Separating Device Of FIGS. 11-16.

When a dime 124 is introduced into the coin separating device 70, that dime will enter, and pass downwardly through, the hollow central portion of coin director 74. The diameter of that dime is less than the shortest straight-line distance between the inner surface of wall 83 of that coin director and the right-hand edge of cam follower 82. Consequently, although that dime may engage the right-hand surface of that cam follower, it will not be able to force that cam follower to rotate in the clockwise direction. The diameter of that dime also is less than the shortest straight-line distance between the wall 107 of coin director 92 and the right-hand surface of cam follower 106. Consequently, although that dime may engage the right-hand surface of that cam follower, it will not be able to force that cam follower to rotate in the clockwise direction. Any engagement between that dime and the wall 83 or the cam follower 82 or any of the lands 80 of the coin director 74 will cause downwardly-directed forces to be applied to that coin director; and those forces will coact with the arms 76 and 78 to tend to rotate that coin director in the counter clockwise direction from the solid-line position of FIG. 12. However, because that dime is light in weight, and because it will not be intercepted and held by cam follower 82, the forces which it will apply to the coin director 74 will not be sufficient to overcome the force that is applied to that coin director by the torsion spring 84. Similarly, any engagement between that dime and the wall 107 or the cam follower 106 or any of the lands 102 of the coin director 92 will cause downwardly-directed forces to be applied to that coin director; and those forces will coact with the arms 94 and 96 to tend to rotate that coin director in the counter clockwise direction from the solid-like position of FIG. 12. However, because that dime is light in weight, and because it wll not be intercepted and held by the cam follower 106, the forces which it will apply to the coin director 92 will not be sufficient to overcome the force that is applied to that coin director by the torsion spring 111. As a result, when a dime is introduced into the coin separating device 70, that dime will move downwardly through the hollow central portion of coin director 74 without moving that coin director, and also will move downwardly through the hollow central portion of coin director 92 without moving that coin director. Consequently, the latter coin director will guide that dime to and through the dime outlet 120.

When a nickel 126 is introduced into the coin separating device 70, that nickel will enter, and pass downwardly through, the hollow central portion of coin director 74. The diameter of that nickel is less than the shortest straight-line distance between the inner surface of wall 83 of that coin director and the right-hand edge of cam follower 82. Consequently, although that nickel may engage the right-hand surface of that cam follower, it will not be able to force that cam follower to rotate in the clockwise direction. Any engagement between that nickel and the wall 83 or the cam follower 84 or any of the lands 80 of the coin director 74 will cause downwardly-directed forces to be applied to that coin director; and those forces will coact with the arms 76 and 78 to tend to rotate that coin director in the counter clockwise direction from the solid-line position of FIG. 12. However, because that nickel is relatively light in weight, and because it will not be intercepted and held by the cam follower 82, the forces which it will apply to the coin director 74 will not be sufficient to overcome the force that is applied to that coin director by the torsion spring 84. As a result, when a nickel is introduced into the coin separating device 70, that nickel will move downwardly through the hollow central portion of coin director 74 without moving that coin director, and will enter the hollow central portion of coin director 92.

The diameter of the nickel will be greater than the shortest straight-line distance between the wall 107 of coin director 92 and the right-hand surface of cam follower 106. Consequently, that wall and that right-hand surface will intercept and hold that nickel. Gravity and the kinetic energy of that nickel will coact with the arms 96 and 98 of the coin director 92 to develop a force which will tend to cause that coin director to start rotating in the counterclockwise direction in FIG. 12. Also, gravity and the kinetic energy of that nickel will cause the cam follower 106 to apply a laterally-directed action force to the cam 112 which will enable that cam to apply a forwardly-directed reaction force to that cam follower. The coin director 92 will respond to those forces to rotate toward the dotted-line position of FIG. 12; and it will carry that nickel as it does so. Gravity and the kinetic energy of that nickel will continue to rotate the coin director 92 forwardly until the cam 112 permits the cam follower 106 to reach the dotted-line position of FIG. 16, wherein the right-hand edge of that cam follower has moved far enough away from the wall 107 of that coin director to permit that nickel to slip downwardly past that cam follower. At that time, the lower end of the coin director 92 will be in register with the nickel outlet 122; and hence that nickel will pass to and through that outlet. After the upper portion of the periphery of that nickel has moved downwardly below the level of the lower edge of that coin director, the spring 111 will automatically move that coin director back to the solid-line position of FIG. 12.

When a quarter 128 is introduced into the coin separating device 70, that quarter will enter the hollow central portion of coin director 74. The diameter of that quarter will be greater than the shortest straightline distance between the wall 83 and the right-hand face of cam follower 82. Consequently, that wall and that right-hand surface will intercept and hold that quarter. Gravity and the kinetic energy of that quarter will coact with the arms 76 and 78 of the coin director 74 to develop a force which will tend to cause that coin director to start rotating in the clockwise direction in FIG. 12. Also, gravity and the kinetic energy of that quarter will cause the cam follower 82 to apply a laterally-directed action force to the cam 88 which will enable that cam to apply a rearwardly-directed reaction force to that cam follower. The coin director 74 will respond to those forces to rotate toward the position of FIG. 14; and it will rotate that quarter as it does so. The kinetic energy of that quarter will continue to rotate the coin director 74 rearwardly until the cam 88 permits the cam follower 82 to move far enough away from the wall 83 of that coin director to permit that quarter to slip downwardly past that cam follower. At that time, the lower end of the coin director 74 will be in register with quarter outlet 118. After the upper portion of the periphery of that quarter has moved downwardly below the level of the lower edge of that coin director, the spring 84 will automatically move that coin director back to the solid-line position of FIG. 12.

When a dollar 130 is introduced into the coin separating device 70, that dollar will enter the hollow central portion of coin director 74. The diameter of that dollar will be greater than the shortest straight-line distance between the wall 83 and the right-hand face of cam follower 82. Consequently, that wall and that right-hand surface will intercept and hold that dollar. Gravity and the kinetic energy of that dollar will coact with the arms 76 and 78 of the coin director 74 to develop a force which will tend to cause that coin director to start rotating in the clockwise direction in FIG. 12. Also, gravity and the kinetic energy of that dollar will cause the cam follower 82 to apply a laterally-directed action force to the cam 88 which will enable that cam to apply a rearwardly-directed reaction force to that cam follower. The coin director 74 will respond to those forces to rotate toward the dotted-line position of FIG. 12; and it will rotate that dollar as it does so. Gravity and the kinetic energy of that dollar will continue to rotate the coin director 74 rearwardly until the cam 88 permits the cam follower 82 to move far enough away from the wall 83 of that coin director to permit that dollar to slip downwardly past that cam follower. At that time, the lower end of the coin director 74 will be in register with the dollar outlet 116; and hence that dollar will pass to and through that outlet. After the upper portion of the periphery of that dollar has moved downwardly below the level of the lower edge of that coin director, the spring 84 will automatically move that coin director back to the solid-line position of FIG. 12.

The various outlet slots in the coin separating devices 20 and 70 are elongated and narrow. As a result, those outlet slots have configurations which are similar to, but larger than, the diametral cross sections of the coins that they accept. Also, those outlet slots have tapered upper edges which help guide coins into those outlet slots.

As shown by FIG. 5, the wall 37 of the coin director 28 extends down to a point immediately adjacent the outlet slot 54; and that wall also extends down to points closely adjacent the outlet slots 52, 56 and 58. As a result, that wall supports and guides the various coins as they move downwardly to, and into, those outlet slots. Similarly, as shown by FIG. 12, the rear wall of coin director 74 extends down to a point close to the outlet slots 116 and 118; and the front and rear walls of coin director 92 extend down to points close to the outlet slots 120 and 122. As a result, those coin directors guide the various coins as they move downwardly to, and into, those outlet slots.

The slug rejectors which test coins and then deliver them to the inlets of the coin separating devices 20 and 70 are not shown in the drawing, because those slug rejectors are not parts of the present invention. If desired, the coin separating devices 20 and 70 could be intimately connected to those slug rejectors, as by being mounted on the frames of those slugs rejectors.

It will be noted that each of the coin separating devices 20 and 70 can direct coins of four different diameters to four different coin outlets. Although those coin separating devices are dimensioned to separate U.S. nickels, dimes, quarters and the new dollars, those coin separating devices could be dimensioned to accommodate various other U.S. coins or various foreign coins.

The operation of each of the coin separating devices 20 and 70 is rapid and automatic. As a result, those coin separating devices are able, almost instantaneously, to accept coins of different diameters and direct those coins to and through outlets which correspond to the diameters of those coins.

Whereas the drawing and accompanying description have shown and described two preferred embodiments of the present invention, it should be apparent to those skilled in the art that various changes may be made in the form of the invention without affecting the scope thereof.

What I claim is:

1. A coin-separating device which has an inlet for coins of a plurality of predetermined diameters, surfaces which define a first plane and which are spaced apart a short distance to define a first slot-like outlet for coins of one of said diameters which is located below the level of said inlet, further surfaces which define a second and different plane and which are spaced apart a short distance to define a second slot-like outlet for coins of a second of said diameters which is located below said level of said inlet, said further surfaces being disposed rearwardly of the first said surfaces to displace said second outlet and said second plane rearwardly of said first outlet and said first plane, a movable coin director that is located below the level of said inlet and that has an entrance and an exit for coins, said movable coin director having two sidewalls fixed relative to each other to define a compartment that receives coins and that selectively directs coins of said one of said diameters to said first slot-like outlet and directs coins of said second of said diameters to said second slot-like outlet, said exit of said coin director being movable in the forward direction toward and in the rearward direction away from said first plane and hence forwardly toward and rearwardly away from said first outlet, said exit of said coin director being movable in the rearward direction toward and in the forward direction away from said second plane and hence rearwardly toward and forwardly away from said second outlet, said coin director being adapted to have said exit thereof in a position wherein said exit causes coins of said one diameter to move from said inlet toward said first plane and said first outlet, said coin director being adapted to have said exit thereof in a second position wherein said exit causes coins of said second diameter to move from said inlet toward said second plane and said second outlet, and coin-diameter-sensing means, said coin-diameter-sensing means and said coin director responding to the weight of a coin of said one diameter to cause said coin director, whenever a coin of said one diameter is introduced into said coin separating device, to have said exit thereof move in said forward direction to be in the first said position wherein said exit will cause said coin of said one diameter to move toward said first plane and said first outlet, and said coin-diameter-sensing means and said coin director responding to the weight of a coin of said second diameter to cause said coin director, whenever a coin of said second diameter is introduced into said coin-separating device, to have said exit thereof move in said rearward direction to be in said second position wherein said exit will cause said coin of said second diameter to move toward said second plane and said second outlet.

2. A coin separating device as claimed in claim 1 wherein said coin director is normally held so its exit is in register with said first outlet, and wherein said coin director and said coin-diameter-sensing means permit said coin director to remain with its exit in register with said first outlet whenever a coin of said one diameter is introduced into said coin separating device.

3. A coin separating device as claimed in claim 1 wherein spring means normally holds said coin director so its exit is in register with said first outlet, and wherein said weight of said coin of said second diameter enables said coin director and said coin-diameter-sensing means to cause said spring means to yield to permit said coin director to move to dispose its exit in register with said second outlet whenever said coin of said second diameter is introduced into said coin separating device.

4. A coin separating device as claimed in claim 1 wherein each of said outlets is elongated and narrow, wherein said outlets are immediately adjacent each other, and wherein sad outlets are closely adjacent said exit of said coin director, whereby said coin director can have said entrance thereof remain close to said inlet as said coin director guides said coin of said one diameter and said coin of said second diameter to said first and said second outlets, respectively, as it directs said coins to said outlets.

5. A coin separating device as claimed in claim 1 wherein said coin-diameter-sensing means comprises a stationary cam, and wherein said weight of said coin of said second diameter causes a force to be applied to said cam which will cause said coin director to move relative to said cam and thereby move in said rearward direction to dispose said exit in said second position.

6. A coin separating device as claimed in claim 1 wherein said coin-diameter-sensing means comprises a cam follower and a cam, and wherein said weight of said coin of said second diameter causes said cam follower to apply a force to said cam which will cause said coin director to move relative to said cam and thereby move in said rearward direction to dispose said exit in said second position.

7. A coin separating device as claimed in claim 1 wherein said coin-diameter-sensing means comprises a stationary cam and a cam follower which moves with said coin director.

8. A coin separating device which has an inlet for coins of a plurality of predetermined diameters, surfaces which define a first plane and which are spaced apart a short distance to define a first slot-like outlet for coins of one of said diameters which is located below the level of said inlet, further surfaces which define a second and different plane and which are spaced apart a short distance to define a second slot-like outlet for coins of a second of said diameters which is located below said level of said inlet, said further surfaces being disposed rearwardly of the first said surfaces to displace said second outlet and said second plane rearwardly of said first outlet and said first plane, a movable coin director that is located below the level of said inlet and that has an entrance and an exit for coins, said exit of said coin director being movable forwardly toward and rearwardly away from said first plane and hence forwardly toward and rearwardly away from said first outlet, said eixt of said coin director being movable rearwardly toward and forwardly away from said second plane and hence rearwardly toward and forwardly away from said second outlet, said coin director being adapted to have said exit thereof in a position wherein said exit causes coins of said one diameter to move from said inlet toward said first plane and said first outlet, said coin director being adapted to have said exit thereof in a second position wherein said exit causes coins of said second diameter to move from said inlet toward said second plane and said second outlet, coin-diameter-sensing means enabling said coin director, whenever a coin of said one diameter is introduced into said coin separating device, to have said exit thereof in the first said position wherein said exit will cause said coin of said one diameter to move toward said first plane and said first outlet, and said coin-diameter-sensing means enabling said coin director, whenever a coin of said second diameter is introduced into said coin-separating device, to have said exit thereof in said second position wherein said exit will cause said coin of said second diameter to move toward said second plane and said second outlet, and a third outlet for coins of a third of said diameters that is located below the level of said inlet, said third outlet being located in a plane which is displaced from said plane in which said second outlet is located, said coin direction being adapted to be in a third position wherein coins of said third diameter move from said inlet to said third outlet, and said coin-diameter-sensing means enabling said coin director, whenever a coin of said third diameter is introduced into said coin separating device, to be in said third position wherein said coin of said third diameter will move to said third outlet.

9. A coin separating device which has an inlet for coins of a plurality of predetermined diameters, a first outlet for coins of one of said diameters which is located below the level of said inlet, a second outlet for coins of a second of said diameters which is located below said level of said inlet, said second outlet being located in a plane which is displaced from the plane in which said first outlet is located, a movable coin director that is located below the level of said inlet and that has an entrance and an exit for coins, said coin director being adapted to be in a position wherein coins of said one diameter move from said inlet to said first outlet, said coin director being adapted to be in a second position wherein coins of said second diameter move from said inlet to said second outlet, and coin-diameter-sensing means enabling said coin director, whenever a coin of said one diameter is introduced into said coin separating device, to be in the first said position wherein said coin of said one diameter will move to said first outlet, said coin-diameter-sensing means enabling said coin director, whenever a coin of said second diameter is introduced into said coin-separating device, to be in said second position wherein said coin of said second diameter will move to said second outlet, a third outlet for coins of a third of said diameters that is located below the level of said inlet, said third outlet being located in a plane which is displaced from said plane in which said second outlet is located, said coin director being adapted to be in a third position wherein coins of said third diameter move from said inlet to said third outlet, said coin director normally being held so its exit is in register with said first outlet, said coin-diameter-sensing means enabling said coin director to move in one direction to dispose its exit in register with said second outlet whenever a coin of said second diameter is introduced into said coin-separating device, and said coin-diameter-sensing means enabling said coin director to move in the opposite direction to dispose its exit in register with said third outlet whenever a coin of said third diameter is introduced into said coin separating device.

10. A coin separating device which has an inlet for coins of a plurality of predetermined diameters, surfaces which define a first plane and which are spaced apart a short distance to define a first slot-like outlet for coins of one of said diameters which is located below the level of said inlet, further surfaces which define a second and different plane and which are spaced apart a short distance to define a second slot-like outlet for coins of a second of said diameters which is located below said level of said inlet, said further surfaces being disposed rearwardly of the first said surfaces to displace said second outlet and said second plane rearwardly of said first outlet and said first plane, a movable coin director that is located below the level of said inlet and that has an entrance and an exit for coins, said movable coin director having two sidewalls fixed relative to each other to define a compartment that receives coins and that selectively directs coins of said one of said diameters to said first slot-like outlet and directs coins of said second of said diameters to said second slot-like outlet, said exit of said coin director being movable forwardly and rearwardly relative to said first outlet, said exit of said coin director being movable forwardly and rearwardly relative to said second outlet, said coin director being adapted to have said exit thereof in a position wherein said exit causes coins of said one diameter to move from said inlet toward said first plane and said first outlet, said coin director being adapted to have said exit thereof in a second position wherein said exit causes coins of said second diameter to move from said inlet toward said second plane and said second outlet, coin-diameter-sensing means, said coin-diameter-sensing means and said coin director responding to the weight of a coin of said second diameter to cause said coin director, whenever a coin of said second diameter is introduced into said coin-separating device, to have said exit thereof be in said second position where said exit will cause said coin of said second diameter to move toward said second plane and said second outlet, and a centering means which normally holds said coin director so its exit is in register with said first outlet, said coin-diameter-sensing means and said coin director responding to the weight of said coin of said second diameter to cause said centering means to yield so it will permit said coin director to move its exit away from said first outlet, and said coin director and said coin-diameter-sensing means permitting said exit of said coin director to remain in register with said first outlet whenever a coin of said one diameter is introduced into said coin separating device.

11. A coin separating device which has an inlet for coins of a plurality of predetermined diameters, a first outlet for coins of one of said diameters which is located below the level of said inlet, a second outlet for coins of a second of said diameters which is located below said level of said inlet, said second outlet being located in a plane which is displaced from the plane in which said first outlet is located, a movable coin director that is located below the level of said inlet and that has an entrance and an exit for coins, said coin director being adapted to be in a position wherein coins of said one diameter move from said inlet to said first outlet, said coin director being adapted to be in a second position wherein coins of said second diameter move from said inlet to said second outlet, and coin-diameter-sensing means enabling said coin director, whenever a coin of said one diameter is introduced into said coin separating device, to be in the first said position wherein said coin of said one diameter will move to said first outlet, said coin-diameter-sensing means enabling said coin director, whenever a coin of said second diameter is introduced into said coin-separating device, to be in said second position wherein said coin of said second diameter will move to said second outlet, a third outlet for coins of a third of said diameters that is located below the level of said inlet, said third outlet being located in a plane which is displaced from said plane in which said second outlet is located, said coin director being adapted to be in a third position wherein coins of said third diameter move from said inlet to said third outlet, a centering means which normally holds said coin director so its exit is in register with said first outlet but which can yield to permit said exit of said coin director to move out of register with said first outlet, said centering means and said coin-diameter-sensing means enabling said coin director to move in one direction whenever a coin of said second diameter is introduced into said coin separating device, and said centering means and said diameter-sensing means enabling said coin director to move in the opposite direction whenever a coin of said third diameter is introduced into said coin separating device.

12. A coin separating device which has an inlet for coins of a plurality of predetermined diameters, surfaces which define a first plane and which are spaced apart a short distance to define a first slot-like outlet for coins of one of said diameters which is located below the level of said inlet, further surfaces which define a second and different plane and which are spaced apart a short distance to define a second slot-like outlet for coins of a second of said diameters which is located below said level of said inlet, said further surfaces being disposed rearwardly of the first said surfaces to displace said second outlet and said second plane rearwardly of said first outlet and said first plane, a movable coin director that is located below the level of said inlet and that has an entrance and an exit for coins, said exit of said coin director being movable forwardly toward said rearwardly away from said first plane and hence forwardly toward and rearwardly away from said first outlet, said exit of said coin director being movable rearwardly toward and forwardly away from said second plane and hence rearwardly toward and forwardly away from said second outlet, said coin director being adapted to have said exit thereof in a position wherein said exit causes coins of said one diameter to move from said inlet toward said first plane and said first outlet, said coin director being adapted to have said exit thereof in a second position wherein said exit causes coins of said second diameter to move from said inlet toward said second plane and said outlet, coin-diameter-sensing means enabling said coin director, whenever a coin of said one diameter is introduced into said coin separating device, to have said exit thereof in the first said position wherein said exit will cause said coin of said one diameter to move toward said first plane and said first outlet, and said coin-diameter-sensing means enabling said coin director, whenever a coin of said second diameter is introduced into said coin-separating device, to have said exit thereof in said second position wherein said exit will cause said coin to said second diameter to move toward said second plane and said second outlet, and said coin-diameter-sensing means including a cam, and said cam causing said coin director to move whenever coins of a predetermined diameter are introduced into said coin separating device.

13. A coin separating device which has an inlet for coins of a plurality of predetermined diameters, surfaces which define a first plane and which are spaced apart a short distance to define a first slot-like outlet for coins of one of said diameters which is located below the level of said inlet, further surfaces which define a second and different plane and which are spaced apart a short distance to define a second slot-like outlet for coins of a second of said diameters which is located below said level of said inlet, said further surfaces being disposed rearwardly of the first said surfaces to displace said second outlet and said second plane rearwardly of said first outlet and said first plane, a movable coin director that is located below the level of said inlet and that has an entrance and an exit for coins, said exit of said coin director being movable forwardly toward and rearwardly away from said first plane and hence forwardly toward and rearwardly away from said first outlet, said exit of said coin director being movable rearwardly toward and forwardly away from said second plane and hence rearwardly toward and forwardly away from said second outlet, said coin director being adapted to have said exit thereof in a position wherein said exit causes coins of said one diameter to move from said inlet toward said first plane and said first outlet, said coin director being adapted to have said exit thereof in a second position wherein said exit causes coins of said second diameter to move from said inlet toward said second plane and said second outlet, coin-diameter-sensing means enabling said coin director, whenever a coin of said one diameter is introduced into said coin separating device, to have said exit thereof in the first said position wherein said exit will cause said coin of said one diameter to move toward said first plane and said first outlet, and said coin-diameter-sensing means enabling said coin director, whenever a coin of said second diameter is introduced into said coin-separating device, to have said exit thereof in said second position wherein said exit will cause said coin to said second diameter to move toward said second plane and said second outlet, and said coin-diameter-sensing means including a cam, each coin of said second diameter acting, while it is held by said coin director, to engage said cam, and said cam and each of said coins of said second diameter acting, whenever said coin of said second diameter is introduced into said coin separating device, to cause said coin director to move into said second position wherein said coin of said second diameter will move to said second outlet.

14. A coin separating device which has an inlet for coins of a plurality of predetermined diameters, a first outlet for coins of one of said diameters which is located below the level of said inlet, a second outlet for coins of a second of said diameters which is located below said level of said inlet, said second outlet being located in a plane which is displaced from the plane in which said first outlet is located, a movable coin director that is located below the level of said inlet and that has an entrance and an exit for coins, said coin director being adapted to be in a position wherein coins of said one diameter move from said inlet to said first outlet, said coin director being adapted to be in a second position wherein coins of said second diameter move from said inlet to said second outlet, and coin-diameter-sensing means enabling said coin director, whenever a coin of said one diameter is introduced into said coin separating device, to be in the first said position wherein said coin of said one diameter will move to said first outlet, said coin-diameter-sensing means enabling said coin director, whenever a coin of said second diameter is introduced into said coin-separating device, to be in said second position wherein said coin of said second diameter will move to said second outlet, said coin-diameter-sensing means including a cam, said coin director including a cam follower, each coin of said second diameter acting, while it is held by said coin director, to cause said cam follower to engage said cam, and said cam and said cam follower acting to cause said coin director to respond to the presence of a coin of said second diameter to move into said second position wherein said coin of said second diameter will move to said second outlet.

15. A coin separating device which has an inlet for coins of a plurality of predetermined diameters, surfaces which define a first plane and which are spaced apart a short distance to define a first slot-like outlet for coins of one of said diameters which is located below the level of said inlet, further surfaces which define a second and different plane and which are spaced apart a short distance to define a second slot-like outlet for coins of a second of said diameters which is located below said level of said inlet, said further surfaces being disposed rearwardly of the first said surfaces to displace said second outlet and said second plane rearwardly of said first outlet and said first plane, a movable coin director that is located below the level of said inlet, additional surfaces which define a third and still different plane and which are spaced apart a short distance to define a third slot-like outlet for coins of a third of said diameters which is located below the level of said inlet, said additional surfaces disposing said third outlet in said third plane and hence in a plane which is displaced from said second plane in which said second outlet is located, a second movable coin director which is located below the level of said inlet, the first said coin director having an entrance and an exit for coins, said second coin director directing coins of said one diameter and coins of said second diameter to said first said coin director but directing coins of said third diameter to said third outlet, said exit of said first said coin director being movable forwardly toward and rearwardly away from said first plane and hence forwardly toward and rearwardly away from said first outlet, said exit of said first coin director being movable rearwardly toward and forwardly away from said second plane and hence rearwardly toward and forwardly away from said second plane, said first coin director being adapted to have said exit thereof in a position where said exit causes coins of said one diameter to move from said inlet of said first coin director toward said first plane and said one outlet, and said first coin director being adapted to have said exit thereof in a position wherein said exit causes coins of said second diameter to move from said inlet of said first coin director toward said second plane and said second outlet.

16. A coin separating device which has an inlet for coins of a plurality of predetermined diameters, a first outlet for coins of one of said diameters which is located below the level of said inlet, a second outlet for coins of a second of said diameters which is located below said level of said inlet, said second outlet being located in a plane which is displaced from the plane in which said first outlet is located, a movable coin director that is located below the level of said inlet and that has an entrance and an exit for coins, said coin director being adapted to be in a position wherein coins of said one diameter move from said inlet to said first outlet, said coin director being adapted to be in a second position wherein coins of said second diameter move from said inlet to said second outlet, and coin-diameter-sensing means enabling said coin director, whenever a coin of said one diameter is introduced into said coin separating device, to be in the first said position wherein said coin of said one diameter will move to said first outlet, said coin-diameter-sensing means enabling said coin director, whenever a coin of said second diameter is introduced into said coin-separating device, to be in said second position wherein said coin of said second diameter will move to said second outlet, said coin-diameter-sensing means including a cam, said coin director including a cam follower, each coin of said second diameter acting, while it is held by said coin director, to cause said cam follower to engage said cam, said cam and said cam follower acting to cause said coin director to respond to the presence of a coin of said second diameter to move into said second position wherein said coin of said second diameter will move to said second outlet, and said cam follower constituting a movable wall of said coin director.

17. A coin separating device which has an inlet for coins of a plurality of predetermined diameters, surfaces which define a first plane and which are spaced apart a short distance to define a first slot-like outlet for coins of one of said diameters which is located below the level of said inlet, further surfaces which define a second and different plane and which are spaced apart a short distance to define a second slot-like outlet for coins of a second of said diameters which is located below said level of said inlet, said further surfaces being disposed rearwardly of the first said surfaces to displace said second outlet and said second plane rearwardly of said first outlet and said first plane, a movable coin director that is located below the level of said inlet and that has an entrance and an exit for coins, said exit of said coin director being movable forwardly toward and rearwardly away from said first plane and hence forwardly toward and rearwardly away from said first outlet, said exit of said coin director being movable rearwardly toward and forwardly away from said second plane and hence rearwardly toward and forwardly away from said second outlet, said coin director being adapted to have said exit thereof in a position wherein said exit causes coins of said one diameter to move from said inlet toward said first plane and said first outlet, said coin director being adapted to have said exit thereof in a second position wherein said exit causes coins of said second diameter to move from said inlet toward said second plane and said second outlet, coin-diameter-sensing means enabling said coin director, whenever a coin of said one diameter is introduced into said coin separating device, to have said exit thereof in the first said position wherein said exit will cause said coin of said one diameter to move toward said first plane and said first outlet, and said coin-diameter-sensing means enabling said coin director, whenever a coin of said second diameter is introduced into said coin-separating device, to have said exit thereof in said second position wherein said exit will cause said coin to said second diameter to move toward said second plane and said second outlet, one side of said coin director being open, said coin-diameter-sensing means including a cam, said cam being disposed adjacent said open side of said coin director, the shortest straight-line distance between said one side and the opposite side of said coin director being smaller than the diameter of said coin of said second diameter, the shortest straight-line distance between said opposite side of said coin director and said cam being smaller than the diameter of said coin of said second diameter, whereby a portion of the periphery of each coin of said second diameter will project out through said one side of said coin director to engage said cam, and said cam and each of said coins of said second diameter acting, whenever said coin of said second diameter is introduced into said coin separating device, to cause said coin director to move into said second position to direct said coin of said second diameter to said second outlet.

18. A coin separating device which has an inlet for coins of a plurality of predetermined diameters, a first outlet for coins of one of said diameters which is located below the level of said inlet, a second outlet for coins of a second of said diameters which is located below said level of said inlet, said second outlet being located in a plane which is displaced from the plane in which said first outlet is located, a movable coin director that is located below the level of said inlet and that has an entrance and an exit for coins, said coin director being adapted to be in a position wherein coins of said one diameter move from said inlet to said first outlet, said coin director being adapted to be in a second position wherein coins of said second diameter move from said inlet to said second outlet, and coin-diameter-sensing means enabling said coin director, whenever a coin of said one diameter is introduced into said coin separating device, to be in the first said position wherein said coin of said one diameter will move to said first outlet, said coin-diameter-sensing means enabling said coin director, whenever a coin of said second diameter is introduced into said coin-separating device, to be in said second position wherein said coin of said second diameter will move to said second outlet, a third outlet for coins of a third of said diameters that is located below the level of said inlet, said third outlet being located in a plane which is displaced from said plane in which said second outlet is located, said coin director being adapted to be in a third position wherein coins of said third diameter move from said inlet to said third outlet, said coin director normally being held in position wherein its exit is in register with said first outlet, said coin-diameter-sensing means enabling said coin director to move in one direction whenever a coin of said second diameter is introduced into said coin-separating device, said diameter-sensing means enabling said coin director to move in the opposite direction whenever a coin of said third diameter is introduced into said coin separating device, one side of said coin director being open, said coin-diameter-sensing means including a cam, said cam being disposed adjacent said open side of said coin director, the shortest straight-line distance between said one side and the opposite side of said coin director being smaller than the diameter of said coin of said second diameter and also being smaller than the diameter of said coin of said third diameter, the shortest straight-line distance between said opposite side of said coin director and said cam being smaller than the diameter of said coin of said second diameter and also being smaller than the diameter of said coin of said third diameter, whereby a portion of the periphery of each coin of said second diameter will project out through said one side of said coin director to engage said cam and whereby a portion of the periphery of each said coin of said third diameter will project out through said one side of said coin director to engage said cam, said cam and each of said coins of said second diameter acting whenever said coin of said second diameter is introduced into said coin separating device, to cause said coin director to move its exit into position to direct said coin of said second diameter to said second outlet, and said cam and each of said coins of said third diameter acting, whenever said coin of said third diameter is introduced into said coin separating device, to cause said coin director to move its exit into position to direct said coin of said third diameter to said third outlet.

19. A coin separating device which has an inlet for coins of a plurality of predetermined diameters, a first outlet for coins of one of said diameters which is located below the level of said inlet, a second outlet for coins of a second of said diameters which is located below said level of said inlet, said second outlet being located in a plane which is displaced from the plane in which said first outlet is located, a movable coin director that is located below the level of said inlet and that has an entrance and an exit for coins, said coin director being adapted to be in a position wherein coins of said one diameter move from said inlet to said first outlet, said coin director being adapted to be in a second position wherein coins of said second diameter move from said inlet to said second outlet, and coin-diameter-sensing means enabling said coin director, whenever a coin of said one diameter is introduced into said coin separating device, to be in the first said position wherein said coin of said one diameter will move to said first outlet, said coin-diameter-sensing means enabling said coin director, whenever a coin of said second diameter is introduced into said coin-separating device, to be in said second position wherein said coin of said second diameter will move to said second outlet, said coin-diameter-sensing means including a cam, said coin director including a cam follower, said cam follower being urged toward said cam by gravity whenever said coin director is in the first said position, each coin of said second diameter acting, while it is held by said coin director, to assist gravity in causing said cam follower to engage said cam, and said cam and said cam follower acting to cause said coin director to respond to the presence of a coin of said second diameter to move into said second position wherein said coin of said second diameter will move to said second outlet.

20. A coin separating device as claimed in claim 1 wherein a pivot is mounted so it is generally parallel to said planes, wherein said pivot rotatably supports the upper portion of said coin director and holds said entrance close to said inlet, wherein centering means normally holds said exit in the first said position but can yield to permit said exit to move away from said first position, and wherein said coin director has arms that encircle said pivot and that mount said coin director eccentrically of said pivot, whereby gravity causes the weight of said coin director to bias said coin director for movement away from said first said position, and whereby the entry of a coin of said second diameter into said coin director will coact with the weight of said coin director to increase the bias which tends to move said coin director away from said first said position.

21. A coin separating device which has an inlet for coins of a plurality of predetermined diameters, a movable coin director that has an inlet and an exit, said inlet of said coin director being located adjacent said inlet of said coin separating device, said exit of said coin director normally being in a first position but being selectively movable to a second position or a third position, said first and said second and said third positions being located in three separate planes, one of said planes being disposed rearwardly of another of said planes, a further of said planes being disposed rearwardly of said one plane and hence also disposed rearwardly of said other plane, said movable coin director having two sidewalls fixed relative to each other to define a compartment that receives coins and that selectively directs said coins to said first position or to said second position or to said third position, said inlet of said coin director being adapted to receive coins of a first diameter from said inlet of said coin separating device and said exit of said coin director being adapted to direct them to said first position, said inlet of said coin director being adapted to receive coins of a second and different diameter from said inlet of said coin separating device and said exit of said coin director being adapted to direct them to said second position, said inlet of said coin director being adapted to receive coins of a further different diameter from said inlet of said coin separating device and said exit of said coin director being adapted to direct them to said third position, coin-diameter-sensing means, said coin-diameter-sensing means and said coin director responding to the weight of a coin of said second and different diameter to force said coin director to cause said exit of said coin director, whenever said coin of said second and different diameter is introduced into said coin separating device, to move away from said first position and toward one of said planes to direct said coin of said second and different diameter to an outlet adjacent said second position, and said coin-diameter-sensing means and said coin director responding to the weight of a coin of said further different diameter to force said coin director to cause said exit of said coin director, whenever said coin of said further different diameter is introduced into said coin-separating device, to move away from said first position toward said further plane to direct said coin of said further different diameter to a further outlet adjacent said third position, said exit of said coin director moving rearwardly as said exit of said coin director moves away from said other plane toward said one plane, said exit of said coin director moving rearwardly as said exit of said coin director moves away from one plane toward said further plane.

22. A coin separating device as claimed in claim 21 wherein said exit of said coin director is adjacent another outlet whenever it is in said first position, and wherein said coin-diameter-sensing means enables coins of said first diameter to enter and pass through said coin director while permitting said exit of said coin director to remain in said first position and hence direct said coins of said first diameter to said other outlet.

23. A coin separating device which has an inlet for coins of a plurality of predetermined diameters, a first outlet for coins of one of said diameters which is located below the level of said inlet, a second outlet for coins of a second of said diameters which is located below said level of said inlet, said second outlet being located in a plane which is displaced from the plane in which said first outlet is located, a movable coin director that is located below the level of said inlet and that has an entrance and an exit for coins, said coin director being adapted to be in a position wherein coins of said one diameter move from said inlet to said first outlet, said coin director being adapted to be in a second position wherein coins of said second diameter move from said inlet to said second outlet, and coin-diameter-sensing means enabling said coin director, whenever a coin of said one diameter is introduced into said coin separating device, to be in the first said position wherein said coin of said one diameter will move to said first outlet, said coin-diameter-sensing means enabling said coin director, whenever a coin of said second diameter is introduced into said coin-separating device, to be in said second position wherein said coin of said second diameter will move to said second outlet, said coin-diameter-sensing means including a cam, said coin director including a cam follower, each coin of said given diameter acting, while it is held by said coin director, to cause said cam follower to engage said cam and force said coin director to move to said second position, and each coin of said further diameter acting, while it is held by said coin director, to cause said cam follower to engage said cam and force said coin director to move to said third position.

24. A coin separating device which has an inlet for coins of a plurality of predetermined diameters, a first outlet for coins of one of said diameters which is located below the level of said inlet, a second outlet for coins of a second of said diameters which is located below said level of said inlet, said second outlet being located in a plane which is displaced from the plane in which said first outlet is located, a movable coin director that is located below the level of said inlet and that has an entrance and an exit for coins, said coin director being adapted to be in a position wherein coins of said one diameter move from said inlet to said first outlet, said coin director being adapted to be in a second position wherein coins of said second diameter move from said inlet to said second outlet, and coin-diameter-sensing means enabling said coin director, whenever a coin of said one diameter is introduced into said coin separating device, to be in the first said position wherein said coin of said one diameter will move to said first outlet, said coin-diameter-sensing means enabling said coin director, whenever a coin of said second diameter is introduced into said coin-separating device, to be in said second position wherein said coin of said second diameter will move to said second outlet, said diameter-sensing means including a cam, said coin director including a cam follower, each coin of said given diameter acting, while it is held by said coin director, to cause said cam follower to engage said cam and force said coin director to move to said second position, each coin of said further diameter acting, while it is held by said coin director, to cause said cam follower to engage said cam and force said coin director to move to said third position, said cam follower responding to each coin of said given diameter to move a predetermined distance relative to said coin director, said cam follower responding to each coin of said further diameter to move a greater predetermined distance relative to said coin director, and said movement by said cam follower through said greater predetermined distance causing said coin director to move from said second position to said third position.

25. A coin separating device which has an inlet for coins of a plurality of predetermined diameters, surfaces which define a first plane and which are spaced apart a short distance to define a first slot-like outlet for coins of one of said diameters which is located below the level of said inlet, further surfaces which define a second and different plane and which are spaced apart a short distance to define a second slot-like outlet for coins of a second of said diameters which is located below said level of said inlet, said further surfaces being disposed rearwardly of the first said surfaces to displace said second outlet and said second plane rearwardly of said first outlet and said first plane, a movable coin director that is located below the level of said inlet and that has an entrance and an exit for coins, said movable coin director having a fixed-wall compartment therein that receives coins and that selectively directs coins of said one of said diameters to said first slot-like outlet and directs coins of said second of said diameters to said second slot-like outlet, said exit of said coin director being movable forwardly and rearwardly relative to said first outlet, said exit of said coin director being movable forwardly and rearwardly relative to said second outlet, said coin director being adapted to have said exit thereof in a position wherein said exit causes coins of said one diameter to move from said inlet toward said first plane and said first outlet, said coin director being adapted to have said exit thereof in a second position wherein said exit causes coins of said second diameter to move from said inlet toward said second plane and said second outlet, coin-diameter-sensing means, said coin-diameter-sensing means and said coin director responding to the weight of a coin of said second diameter to cause said coin director, whenever a coin of said second diameter is introduced into said coin-separating device, to have said exit thereof be in said second position wherein said exit will cause said coin of said second diameter to move toward said second plane and said second outlet, and coin-diameter-sensing means, said outlets being immediately adjacent each other, whereby only limited movement of said coin director is needed to move said exit from the first said position to said second position, said coin-diameter-sensing means and said coin director responding to the weight of a coin of said one diameter to cause said coin director, whenever a coin of said one diameter is introduced into said coin-separating device, to experience a predetermined kind of positioning, and said coin-diameter-sensing means and said coin director responding to the weight of a coin of said second diameter to cause said coin director, whenever a coin of said second diameter is introduced into said coin-separating device, to experience a different kind of positioning.

26. A coin separating device which has an inlet for coins of a plurality of predetermined diameters, surfaces which define a first plane and which are spaced apart a short distance to define a first slot-like outlet for coins of one of said diameters which is located below the level of said inlet, further surfaces which define a second and different plane and which are spaced apart a short distance to define a second slot-like outlet for coins of a second of said diameters which is located below said level of said inlet, said further surfaces being disposed rearwardly of the first said surfaces to displace said second outlet and said second plane rearwardly of said first outlet and said first plane, a movable coin director that is located below the level of said inlet and that has an entrance and an exit for coins, said exit of said coin director being movable forwardly toward and rearwardly away from said first plane and hence forwardly toward and rearwardly away from said first outlet, said exit of said coin director being movable rearwardly toward and forwardly away from said second plane and hence rearwardly toward and forwardly away from said second outlet, said coin director being adapted to have said exit thereof in a position wherein said exit causes coins of said one diameter to move from said inlet toward said first plane and said first outlet, said coin director being adapted to have said exit thereof in a second position wherein said exit causes coins of said second diameter to move from said inlet toward said second plane and said second outlet, coin-diameter-sensing means enabling said coin director, whenever a coin of said one diameter is introduced into said coin separating device, to have said exit thereof in the first said position wherein said exit will cause said coin of said one diameter to move toward said first plane and said first outlet, and said coin-diameter-sensing means enabling said coin director, whenever a coin of said second diameter is introduced into said coin-separating device, to have said exit thereof in said second position wherein said exit will cause said coin to said second diameter to move toward said second plane and said second outlet, and a third outlet for coins of a third of said diameters that is located below the level of said inlet, said third outlet being located in a plane which is displaced from said second plane in which said second outlet is located, said coin director being adapted to be in a third position wherein coins of said third diameter move from said inlet to said third outlet, said coin-diameter-sensing means enabling said coin director, whenever a coin of said third diameter is introduced into said coin separating device, to be in said third position wherein said coin of said third diameter will move to said third outlet.

27. A coin separating device which has an inlet for coins of a plurality of predetermined diameters, a movable coin director that has an entrance which is located adjacent said inlet and that has an exit spaced from said inlet, said coin director having two sidewalls fixed relative to each other to define a compartment that receives coins and that is adapted to dispose said exit of said coin director in a plurality of rearwardly-displaced planes, surfaces which are spaced apart a short distance to define a first of said plurality of rearwardly-displaced planes and to define a first outlet to receive coins from said exit whenever said exit is in said first plane, further surfaces which are spaced apart a short distance to define a second of said plurality of rearwardly-displaced planes and to define a second outlet in said second of said planes to receive coins from said exit whenever said exit is in said second plane, said second plane being disposed rearwardly of said first plane, and coin-diameter-sensing means which coact with said coin director to respond to the weight of each coin of a predetermined diameter to cause said coin director to move said exit thereof into register with said second outlet in said second of said planes.

28. A coin separating device as claimed in claim 28 wherein said coin director has at least a portion thereof supporting and moving said coins of said predetermined diameter rearwardly as said coin director moves said exit thereof rearwardly into register with said second outlet.

* * * * *